United States Patent [19]

Schneider, Larry

[11] Patent Number: 4,925,068

[45] Date of Patent: May 15, 1990

[54] LIQUID DISPENSER

[75] Inventor: Schneider, Larry, Waukegan, Ill.

[73] Assignee: Alko, Ltd., Finland

[21] Appl. No.: 244,063

[22] Filed: Sep. 13, 1988

[51] Int. Cl.[5] ..... B67D 3/00

[52] U.S. Cl. ..... 222/484; 222/481; 222/548; 222/153

[58] Field of Search ..... 222/481, 482, 484, 548, 222/549, 554, 563, 153, 570

[56] References Cited

U.S. PATENT DOCUMENTS

| | | | |
|---|---|---|---|
| D. 133,910 | 7/1941 | Houghton . | |
| D. 210,565 | 3/1968 | Kearney . | |
| 1,738,220 | 12/1929 | Amsden . | |
| 2,286,906 | 6/1942 | Gaines . | |
| 3,469,739 | 9/1969 | Phillips . | |
| 2,545,350 | 3/1951 | Fuld . | |
| 2,618,800 | 11/1952 | Raab . | |
| 2,689,064 | 9/1954 | Willis . | |
| 2,717,727 | 9/1955 | Robb . | |
| 2,725,161 | 11/1955 | Browning . | |
| 2,772,027 | 11/1956 | Chircop . | |
| 2,817,451 | 12/1957 | Giles et al. | 222/548 |
| 2,858,054 | 10/1958 | Harkrader . | |
| 2,924,393 | 2/1960 | Robert . | |
| 3,104,786 | 9/1963 | Sanchis | 222/481 |
| 3,122,285 | 2/1964 | Pluess . | |
| 3,139,224 | 6/1964 | Bloom . | |
| 3,163,337 | 12/1964 | Wilson | 222/484 |
| 3,258,179 | 6/1966 | Cherba . | |
| 3,355,072 | 11/1967 | Sheppard et al. . | |
| 3,384,276 | 5/1968 | Henningfield | 222/484 |
| 3,422,998 | 1/1969 | Murray | 222/563 |
| 3,782,610 | 1/1974 | Gilbert | 222/484 |
| 4,181,245 | 1/1980 | Norris . | |
| 4,191,315 | 3/1980 | Funke . | |
| 4,193,524 | 3/1980 | Fleming | 222/484 |
| 4,241,855 | 12/1980 | Yoshioka . | |
| 4,583,665 | 4/1986 | Barriac | 222/153 |
| 4,792,054 | 12/1988 | Weidman | 222/548 |
| 4,802,610 | 2/1989 | Cheek et al. | 222/484 |

*Primary Examiner*—F. J. Bartuska
*Assistant Examiner*—Steve Reim
*Attorney, Agent, or Firm*—Darby & Darby

[57] ABSTRACT

A liquid dispenser for being affixed to the neck of a liquid-filled container or bottle comprises a cap having a spout and a vent, an inner core for insertion in a cylindrical inner cavity of the cap and a stopper assembly attached to the inner core. The cap is rotatable about the inner core and stopper assembly between an open and closed position. Dispensing channels and venting channels in the core and stopper assembly align with the spout and vent in the cap in the open position. The dispensing channels and venting channels are disconnected from the spout and vent in the closed position. Various provisions are made so that the dispenser will be leak-proof in storage and in use. A tamper-evident arrangement is included in a portion of the dispenser. Specific features are provided in the neck of a bottle upon which the dispenser is to be affixed in order to position and lock the dispenser in place.

16 Claims, 3 Drawing Sheets

LIQUID DISPENSER

BACKGROUND OF THE INVENTION

1. Field of the Invention

The present invention relates to a liquid dispenser. More particularly, it relates to a reclosable pouring attachment to be used with bottles, containers and the like which contain a liquid material to be dispensed.

2. Background Prior Art

A common type of reclosable, dispensing or pouring device for use with bottles or containers comprises several parts, each of which have an aperture. Rotation of these parts serves to align the apertures, so that dispensing of material contained in the bottle becomes possible.

One problem encountered with such devices is that they can be difficult to rotate if the material to be dispensed adheres to the surfaces of the parts of the devices. Further inconveniences can arise due to poor construction or design. This may result in the pouring device being accidentally opened, detached from the container, or otherwise rendered inoperative because of poor sealing and accidental discharge of the contained material.

Another drawback of pouring devices commonly used for dispensing alcoholic beverages and other toxic liquids is that they are not usually designed to prevent young children from accidentally discharging and consuming the contents.

Further, none of the known reclosable dispensing devices are believed to be sufficiently leakproof to be able to be affixed to a liquid-filled container, which then must be shipped, stored and displayed for sale.

In this regard, U.S. Pat. No. 1,346,137 to Silverthorne is directed to a rotatable and reclosable pouring device attached to a bottle for the dispensing of ink. While this device includes dispensing and venting paths, the use of metallic clamps for affixing the device to a bottle and for providing rotational capabilities would be impractical for manufacture and unsuitable for leakproof dispensing of alcoholic beverages.

OBJECTS OF THE INVENTION

It is an object of the present invention to provide a liquid dispenser which can be easily opened for dispensing liquid from a container to which it is attached, and readily closed after the liquid is dispensed.

It is another object of the invention to provide a liquid dispenser for attachment to a container which may be opened and closed by a simple rotary motion.

It is another object of the invention to provide a leakproof dispenser for alcoholic beverages which, upon attachment to a bottle or container, positively prevents or allows dispensing of the alcoholic contents of the bottle or container.

It is yet another object of the present invention to provide a reclosable dispenser for attachment to a liquid filled container which is tamper-evident prior to initial use.

SUMMARY OF THE INVENTION

In accordance with the invention, a liquid dispenser for being affixed to the neck of a container or bottle comprises a cap having a spout and a vent wherein the cap has a substantially cylindrical inner cavity defined by a cylindrical inner side wall and an inner top wall. The inner cavity is connected to the spout and vent by a dispensing channel and venting channel, respectively, disposed in the cap. An inner core is also included which has a substantially cylindrical outer wall having an intermediate dispensing channel and intermediate venting channel. The outer wall of the core slidably engages the inner side wall of the cap. The inner core is inserted in the cavity of the cap and is rotatably attached to the cap. A stopper assembly is also included which is attached to the inner core. The stopper assembly has a venting conduit and a dispensing conduit. The stopper assembly is for being inserted into a neck of a bottle or container. The cap is rotatable about the inner core and stopper assembly between an open and closed position of the dispenser. In the open position, the dispensing conduit, intermediate dispensing channel and dispensing channel are connected together to form a dispensing path and the venting conduit, intermediate venting channel and venting channel are connected together to form a venting path so that liquid entering the dispensing conduit can be freely dispensed from the spout. In a non-dispensing position, the vent and spout are disconnected from the venting conduit and dispensing conduit in the stopper assembly to prevent flow of liquid from the spout and vent.

For a better understanding of the present invention, reference is made to the following description and accompanying drawings while the scope of the invention will be pointed out in the appended claims.

DESCRIPTION OF THE PREFERRED EMBODIMENT

Figure 1:
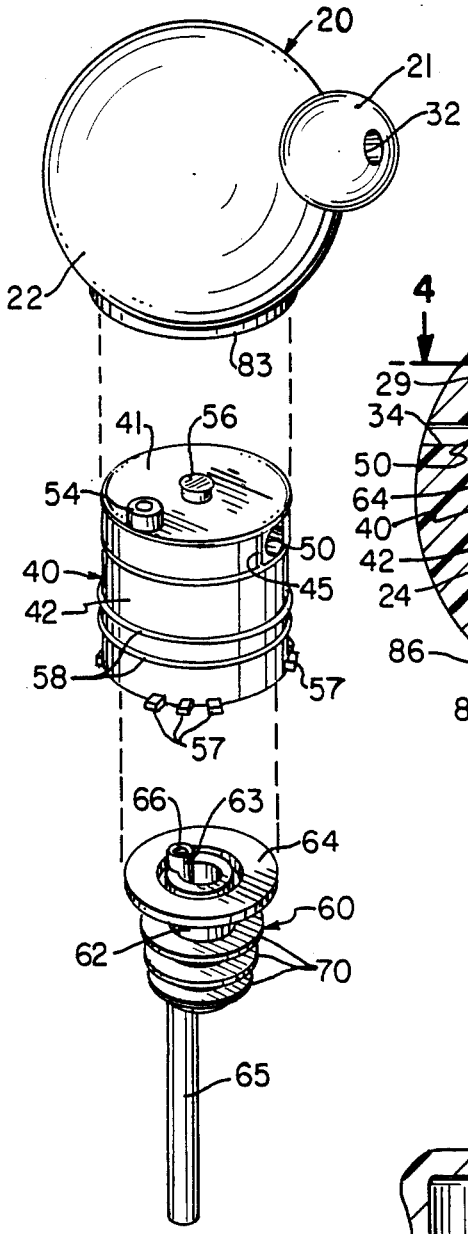
FIG. 1 is an exploded, perspective view of the three major elements of a liquid dispenser in accordance with the invention.
Figure 2:
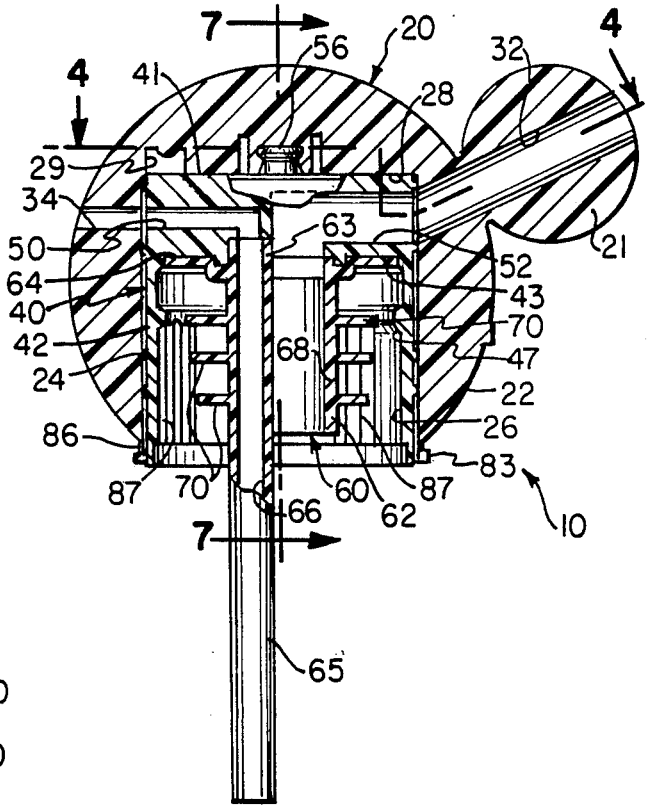
FIG. 2 is a partial vertical cross-sectional view of the assembled dispenser in accordance with the invention.

Referring initially to FIGS. 1 and 2, the assembly of a liquid dispenser in accordance with the invention is illustrated. Liquid dispenser 10 includes a rotatable cap 20, inner core 40 and a stopper assembly 60. Cap 20 includes a main spherical body 22 and a spout 21 which is also preferably spherically shaped. The two spherical elements 21 and 22 are attached to each other.

Cap 20 has an inner cavity 24 which is defined by a substantially cylindrical side wall 26 and a top wall 28. The spout includes a opening 32 which is connected to the inner cavity by means of a dispensing channel 52. Also disposed in the cap is a vent 34 which is connected to the inner cavity. The diameter of the dispensing opening 32 is preferably substantially larger than that of the vent 34.

Figure 4:
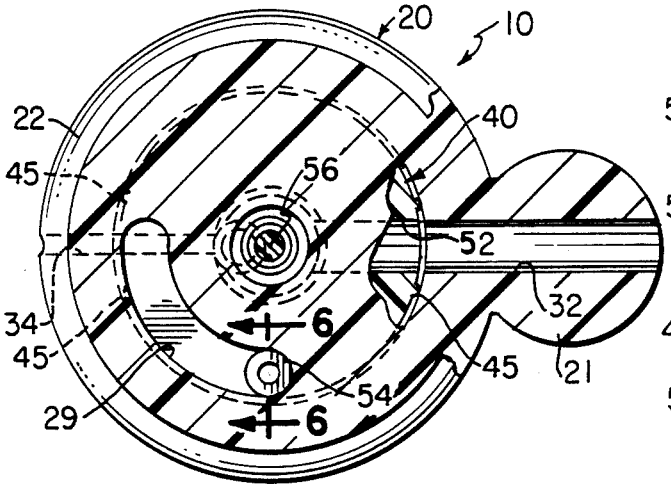
FIG. 4 is a horizontal cross-sectional view of the cap of the liquid dispenser of the present invention in a dispensing condition taken along the line 4—4 of FIG. 2.
Figure 6:
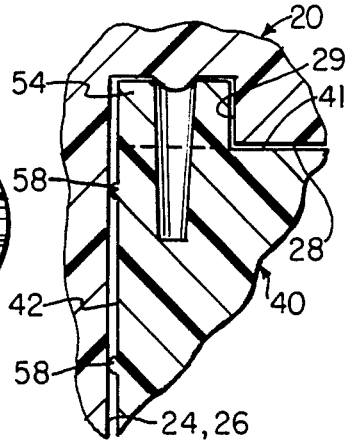
FIG. 6 is an exploded vertical cross-sectional view of the upper assembly of cap and stopper of the liquid dispenser taken along 6—6 of FIG. 4.

The top wall 28 of the cap is shown in FIGS. 4 and 6 to have a guiding groove or guiding means 29. Groove 29 generally has an arc-shaped configuration and extends about 1/4 of the circumference of the cylindrical side wall 26. As will be discussed below, this arrangement is intended to limit rotational travel of the cap.

Figure 3:
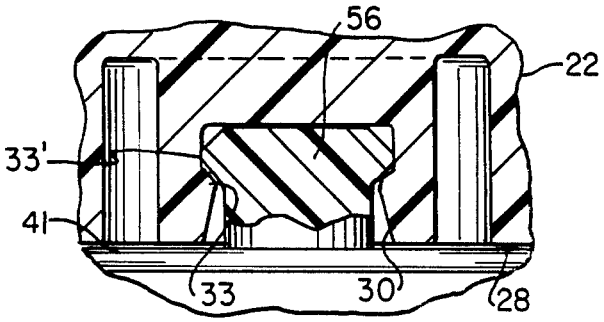
FIG. 3 is a partial vertical cross-sectional view of the means for coupling the stopper assembly of the dispenser to the cap.

Axial recess 30, shown in FIGS. 2 and 3, is also positioned within the top wall 28 of the cap. Recess 30 is defined by a wall which includes a lip portion 33 extending inwardly. An axial member 56 affixed to the inner core and having a corresponding lip portion 33, extends into the recess 30 to enable rotation of the cap with respect to the inner core.

Still referring to FIGS. 1 and 2, inner core 40 includes a substantially cylindrical side wall 42 having a top wall 41. The other end of inner core 40 is open. Top wall 41 has an interior surface 43. An intermediate venting channel 50 and an intermediate dispensing channel 52 are disposed in inner core 40.

Engaging member 54 is provided on a peripheral edge of top wall 41 of the inner core. In an assembled condition of the dispenser (see FIG. 4), guide groove 29 receives and guides engaging member 54 so as to limit the travel of the engaging member within the cap 20 during the rotation of the outer body about the inner core 40 to about 90°. This limits the travel of the dispenser to a relatively short distance between open and closed conditions and also permits orientation of the dispenser with respect to a label affixed to a bottle.

Axial member 56 protrudes from a central part of top wall 41 of the inner core 40. Axial member 56 is rotatably mounted within recess 30. As shown in FIG. 3, lip portion 33, of the axial member 56 is prevented by the corresponding shape of the recess (lip portion 33) from disengaging from the recess during rotation of the cap.

A plurality of sliding and sealing ribs 58 is annularly disposed about the inner core as shown in FIG. 1. These ribs 58 preferably have a substantially rounded configuration. The ribs contact side wall 26 of the cap and provide a sliding and sealing engagement between the cap 20 and inner core 40. In a preferred form of the invention, only upper ribs actually engage and provide a seal with the cap while the lower ribs merely prevent wobble of the cap during use and do not function as a seal.

Sealing elements 45 are provided at the entry of intermediate dispensing channel 52 and intermediate venting channel 54 on the inner core 40 to provide a proper seal for channels. These sealing elements 45 protrude outwardly from the side wall 42 and are in line with outer surfaces of those ribs 58 which act as seals. Thus, the sealing elements 45 are adapted for close engagement with the inner side wall of the cap during operation of the dispenser. All of the sealing arrangements (ribs 58 and sealing elements 45) are provided so that the dispenser will not leak during storage or use.

A plurality of protrusions 57 is disposed about the lower portion of side wall 42 to promote engagement with a tamper-evident strip to be provided at the junction of the dispenser and neck of the bottle.

Stopper assembly 60 includes a cylindrical body 62, a venting tube 65 affixed to and disposed within the body and a plurality of annular engaging elements 70 attached to and surrounding the body. - The venting tube includes a venting conduit 66, which extends through the venting tube. The cylindrical body 62 includes a dispensing conduit 68. The annular element located at one end of the assembly is a mounting flange 64. Annular engaging elements 70 preferably have diameters which gradually decrease in the direction away from flange 64. This set of elements of decreasing diameter facilitates the insertion of the stopper assembly into a neck of a bottle or container. An upper part 63 of venting tube 65 extends beyond the flange 64.

In general, it is preferable to have the inner diameters of the dispensing passages 68, 52 and 32 to be substantially the same. Similarly, the inner diameters of venting passages 66, 50 and 34 are also preferably the same.

It should be understood that the liquid dispenser of the invention is intended to mate with and be sized for the neck of a bottle of known dimensions and configuration. Otherwise, it would be impossible to guarantee leakproof performance of the dispenser.

The stopper assembly 60 is preferably permanently attached to the inner core 40 to define one inseparable unit. Flange 64 is connected to the interior surface 43 of the inner core by any known means, but, preferably by ultrasonic bonding. A preferred material for construction of the elements of the dispenser is a polyethylene-based thermoplastic. As a result of the connection of stopper assembly to inner core, the upper part 63 of the venting conduit 66 is connected to the intermediate venting channel 50 of the inner core and the dispensing conduit 68 of the stopper assembly is connected to the intermediate dispensing channel 52 of the inner core.

Figure 8:
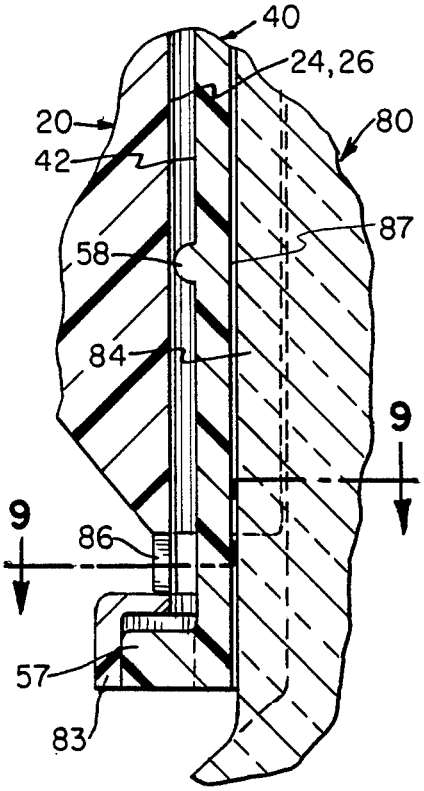
FIG. 8 is an exploded cross-section along 8—8 of FIG. 9 of the lower portion of the assembly of dispenser and bottle shown in FIG. 7.
Figure 7:
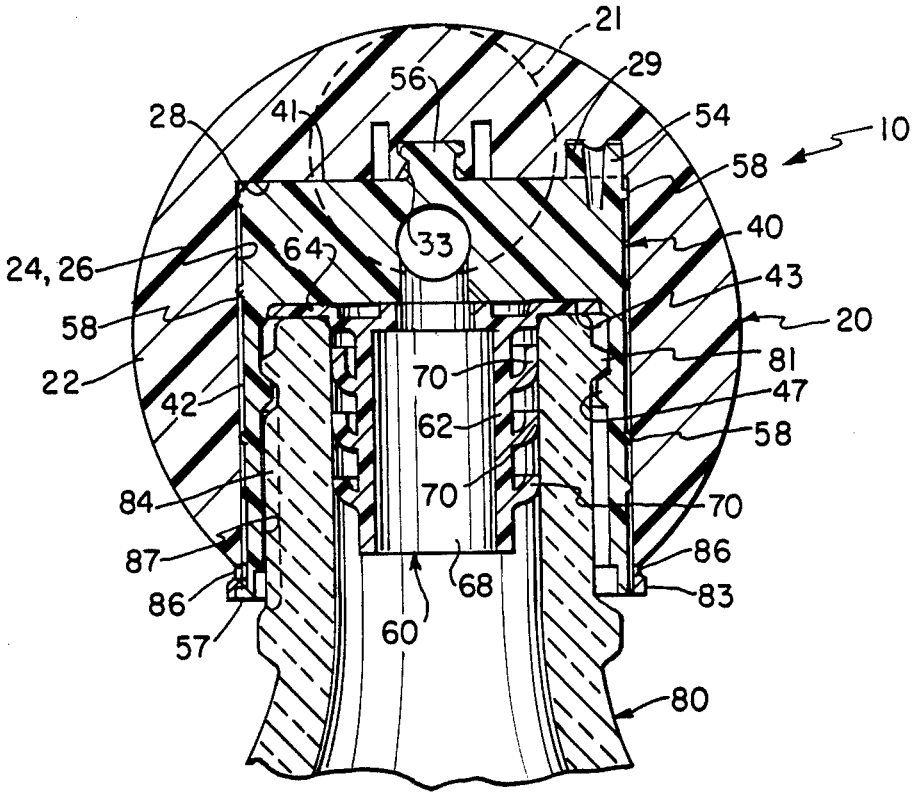
FIG. 7 is a vertical cross section of the liquid dispenser of the present invention affixed to the neck of a bottle taken along 7—7 of FIG. 2.
Figure 9:
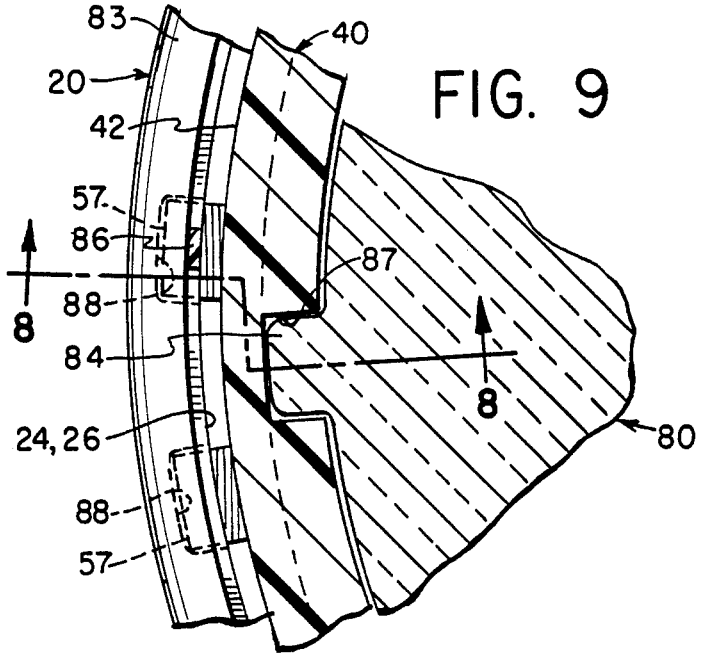
FIG. 9 is an exploded cross-section along 9—9 of FIG. 8 of the lower portion of the assembly of dispenser and bottle shown in FIG. 7.

The interrelationship and assembly of dispenser and bottle is shown with reference to FIGS. 7, 8 and 9. The bottle 80 preferably includes an upper annular ridge 81 and an external vertical alignment rib 84. These elements function to position the dispenser with respect to the bottle and hold the dispenser in place during use. The assembled dispenser 10 is force-fit into the bottle 80 after initial alignment of the vertical rib 84 with a corresponding alignment groove 87 disposed in inner core 40. The insertion of the alignment rib 84 in the alignment groove 87 also functions to prevent rotation of the inner core and stopper with respect to the bottle 80.

The dispenser 10 is pushed onto the bottle until the meeting of flange 64 with the top of the bottle. In the process of insertion, annular ridge 81 will be pushed passed an annular ridge 47 disposed internal to the inner core so that ridge 47 will effectively lock the dispenser in place by pressure exerted against ridge 81. Annular elements 70 will be forced upwardly to function as a tight internal seal for the bottle.

A tamper-evident strip 83 is affixed to the lower part of the cap at a juncture 86. The strip is attached by a bonding operation at the juncture 86. As previously mentioned, protrusions 57 cooperate with recesses 88 in the tamper-evident strip to prevent rotation of the cap prior to breaking of the strip. The cooperation of protrusions and recesses enable the cap to be turned so as to break the strip upon initial use.

In use, after breaking of the tamper-evident strip, the cap 20 is rotatable about the inner core 40 and stopper assembly 60 between an open (dispensing) and closed (non-dispensing) position of the dispenser. In order to place the dispenser 10 in an open condition (as shown in FIG. 2), the cap is rotated about inner core 40 approximately 90° (or to the end of travel as limited by the guiding groove 29 and engaging member 54). During the rotation, the cap is supported by the axial member 56 which allows the rotation to occur. Sealing ribs 58 contact and slidingly engage the side wall of the cap.

In the open position, the spout opening 32 of the cap is connected, through the intermediate dispensing channel 52 of the inner core and the dispensing conduit 68 of the stopper assembly, with the interior of the bottle 80. At the same time, the exterior of the dispenser (i.e. the atmosphere) is connected with trapped air or gas in the bottle by the venting arrangement. In FIG. 2, this venting arrangement provides that the vent 34 connects the exterior of the dispenser by way of venting channel 50 and venting conduit 66 with the trapped interior gas or air within the bottle. This venting arrangement permits the contained liquid to be freely dispensed. The preferred length of the venting tube 65 is about 1 3/4" for insertion in a bottle of about 12 inches high.

In the closed position, the dispenser cap (see FIG. 5) is rotated by about 90° in the opposite direction so as to disconnect the vent 34 and the spout opening 32 from the venting channel and the intermediate dispensing channel, respectively. By virtue of the various seals in the dispenser, the liquid contained in the bottle will not leak out.

Figure 5:
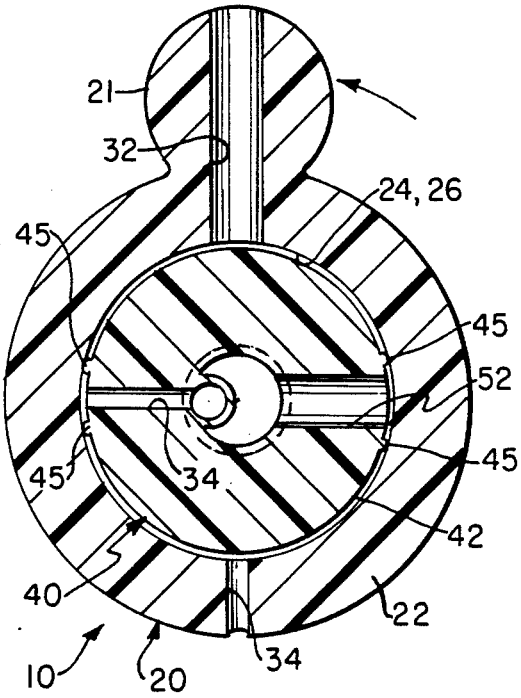
FIG. 5 is a horizontal cross-sectional view of the cap of the liquid dispenser of the present invention in a non-dispensing condition.

In FIG. 2, it is shown that venting openings 34, 50 and 66 and dispensing openings 32, 52 and 68 are positioned in the same plane. FIG. 5 illustrates that the dispensing opening 32 and the venting opening 34 are diametrically opposed to each other. Liquid dispensers having venting and/or dispensing openings in different planes or at an angle other than 180° with respect to each other are within the present invention.

While the foregoing description and drawings represent the preferred embodiments of the present invention, it will be obvious to those skilled in the art that various changes and modifications may be made therein without departing from the true spirit and scope of the present invention.

What is claimed is:

1. A liquid dispenser for being affixed to the neck of a container or bottle, said container or bottle neck having a discharge opening including generally cylindrical inner and outer neck walls, comprising:

a cap having a spout and a vent, said cap having a substantially cylindrical inner cavity defined by a cylindrical inner side wall and an inner top wall, said inner cavity being connected to said spout and vent by a dispensing channel and venting channel, respectively, disposed in said cap;

an inner core having substantially cylindrical inner and outer walls and having an intermediate dispensing channel and intermediate venting channel, the outer wall of said core slidably engaging said inner side wall of said cap, said inner core being inserted in said cavity and rotatably attached to said cap, the inner wall of said core being dimensioned to engage the outer wall of said neck; and a stopper assembly attached to said inner core, said stopper assembly having a venting conduit and a dispensing conduit, said stopper assembly being dimensioned and shaped to be received in said neck so as to engage the inner wall of said neck;

said cap being rotatable about said inner core and said stopper assembly between an open and closed position of the dispenser; in the open position, said dispensing conduit, intermediate dispensing channel and dispensing channel being connected together to form a dispensing path and said venting conduit, intermediate venting channel and venting channel being connected together to form a venting path so that liquid entering said dispensing conduit can be freely dispensed from said spout and, in the closed position, the vent and spout being disconnected from the venting conduit and dispensing conduit in said stopper assembly, respectively, to prevent flow of liquid from said spout or vent, said dispenser simultaneously and continuously engaging both the inner and outer neck walls when said dispenser is affixed to said bottle or container.

2. The liquid dispenser of claim 1, including means to limit the rotation of the cap with respect to said inner core.

3. The dispenser of claim 2, wherein the rotation limiting means include a protruding member at an end of said core cooperating with a guide groove in said cap.

4. The dispenser of claim 2, wherein said means limits the rotation of said cap to approximately 90°.

5. The dispenser of claim 1, including an axial member protruding from the top of the inner core which is disposed in an axial recess located within said cap, said axial member and axial recess allowing the rotation of said cap about said core.

6. The dispenser of claim 1, including sealing means disposed about the cylindrical outer wall of said inner core to prevent leakage of liquid from the dispenser.

7. The dispenser of claim 6 wherein said sealing means include annular rings disposed about the inner core outer wall and seals disposed on the inner core outer wall about end openings of said intermediate dispensing and venting channels.

8. The dispenser of claim 1, wherein the stopper assembly and core are inseparably attached to one another.

9. The dispenser according to claim 1, wherein said stopper assembly includes an engaging flange at one end to allow mounting of the assembly within the inner core and also includes a plurality of annular flexible members of decreasing diameters for assisting in the insertion of the stopper assembly into a neck of a bottle, and for providing said engagement with said inner neck wall and a seal for fluid contained in the bottle.

10. The dispenser according to claim 1, wherein the stopper assembly includes an elongated venting tube for extending into a bottle to enable fluid to be dispensed without difficulty.

11. In combination, a bottle or container having a neck containing liquid to be dispensed and a liquid dispenser affixed to the neck of said bottle, said container or bottle neck having a discharge opening including generally cylindrical inner and outer neck walls, said dispenser comprising:

a cap having a spout and a vent, said cap having a substantially cylindrical inner cavity defined by a cylindrical inner side wall and an inner top wall, said inner cavity being connected to said spout and vent by a dispensing channel and venting channel, respectively, disposed in said cap;

an inner core having substantially cylindrical inner and outer walls and having an intermediate dispensing channel and intermediate venting channel, the outer wall of said core slidably engaging said inner side wall of said cap, said inner core being inserted in said cavity and rotatably attached to said cap, the inner wall of said core engaging the outer wall of said neck; and a stopper assembly attached to said inner core, said stopper assembly having a venting conduit and a dispensing conduit, said stopper assembly being inserted into the neck of the bottle or container and engaging the inner wall of said neck;

said cap being rotatable about said inner core and said stopper assembly between an open and closed position of dispenser; in the open position, said dispensing conduit, intermediate dispensing channel and dispensing channel being connected together to form a dispensing path and said venting conduit, intermediate venting channel and venting channel being connected together to form a venting path so that liquid contained in the bottle can be dispensed from said spout, and in the closed position, the venting opening and spout are disconnected from the venting conduit and dispensing conduit in said stopper assembly, respectively, to prevent flow of liquid from said spout or vent, said dispenser simultaneously and continuously engaging both the inner and outer neck walls of said bottle or container.

12. The combination of claim 11 including a tamperevident strip disposed on a lower part of said dispenser and also including engaging means on said inner core for cooperating with said tamper-evident strip to prevent rotation of said cap relative to said inner core prior to initial use.

13. The combination of claim 11 including means on said bottle and dispenser to prevent rotation of said inner core and stopper relative to the bottle.

14. The combination of claim 13 wherein said means includes a cooperating vertical bar on said bottle and a vertical groove in said inner core.

15. The combination of claim 11 including means for preventing removal of said dispenser after insertion in said bottle.

16. The combination of claim 15 wherein said means includes an annular ridge on the neck of the bottle extending beyond an annular ridge internal to said inner core.

* * * * *